United States Patent [19]

Takahashi et al.

[11] 4,275,253

[45] Jun. 23, 1981

[54] RADIATION RESISTANT OIL AND METHOD OF LUBRICATING FOR ATOMIC POWER FACILITIES

[75] Inventors: Masaaki Takahashi; Akira Ito, both of Tokyo, Japan

[73] Assignee: Kureha Kagaku Kogyo Kabushiki Kaisha, Nohonbashi, Japan

[21] Appl. No.: 949,617

[22] Filed: Oct. 10, 1978

Related U.S. Application Data

[63] Continuation-in-part of Ser. No. 760,246, Jan. 17, 1977, abandoned, which is a continuation-in-part of Ser. No. 454,663, Mar. 25, 1974, abandoned.

[30] Foreign Application Priority Data

Mar. 29, 1973 [JP] Japan ..... 48/35028

[51] Int. Cl.[3] ..... C07C 2/00; C07C 13/28; C07C 15/24

[52] U.S. Cl. ..... 585/7; 585/25; 585/26; 585/422; 585/944

[58] Field of Search ..... 252/59; 260/668 R, 668 F; 585/26, 7, 422, 25

[56] References Cited

U.S. PATENT DOCUMENTS

| | | | |
|---|---|---|---|
| 2,837,583 | 6/1958 | Lien et al. | 260/668 F X |
| 3,047,501 | 7/1962 | Brook et al. | 252/59 X |
| 3,094,488 | 6/1963 | Beerbower et al. | 252/59 X |
| 3,262,882 | 7/1966 | Gupta et al. | 252/59 |
| 3,272,882 | 9/1966 | van Venrooy | 260/668 F |
| 3,331,778 | 7/1967 | Giuliani | 252/59 X |
| 3,437,695 | 4/1969 | Kruse | 260/688 R |
| 3,661,780 | 5/1972 | Feighner et al. | 252/59 |
| 3,766,285 | 10/1973 | Boggs et al. | 252/59 X |

OTHER PUBLICATIONS

Amaury, Chem. Abstracts, vol. 48, p. 731 b.
Cort et al., Chem. Abstracts, vol. 61, p. 14596h.
Rodenbusch, "Lubricants and Nuclear Radiation", 1966, Chem. Abstracts, vol. 65, 1966, 16745b.

*Primary Examiner*—Andrew Metz

[57] ABSTRACT

A radiation resistant working oil for lubricating parts of atomic power facilities which are exposed to radioactive rays consists essentially of alpha-benzyl substituted methylnaphthalene isomers and beta-benzyl substituted methylnaphthalene isomers in the ratio of about 1:0.2–1:1.

3 Claims, No Drawings

RADIATION RESISTANT OIL AND METHOD OF LUBRICATING FOR ATOMIC POWER FACILITIES

RELATED APPLICATION

This application is a continuation-in-part of our copending application entitled "Radiation Resistant Oil and Method of Lubricanting for Atomic Power Facilities," Ser. No. 760,246, filed Jan. 17, 1977, and now abandoned which is in turn a continuation-in-part application of Ser. No. 454,663, filed Mar. 25, 1974, for "Radiation Resistant Oil," now abandoned.

FIELD OF THE INVENTION

This invention relates to a novel Radiation Resistant Oil.

BACKGROUND OF THE INVENTION

Atomic power facilities include parts which move relative to each other and which require lubrication, such as hydraulic actuators, hydraulic shock absorbers, vibration insulators, and other parts which are exposed to radioactive rays. Working oil useful in lubricating such parts of atomic power facilities are generally required to possess high resistance to radioactive rays. In consequence of the recent growth of the nuclear power industry, the resistance of lubricants to radioactive rays in attracting serious attention. The issue has placed an impetus on studies directed to providing new oils possessing high resistance to radioactive rays sufficient for them to be used as such working oil.

As substances having high resistance to radioactive rays, therehave heretofore been discovered polycyclic aromatic condensation compounds such as naphthalene, anthracene and pyrene; polyphenyls such as diphenyl and terphenyl; and polyphenyl ether. However, all these compounds are solid at normal room temperature. In order for these substances to be used as working oil, therefore, it is necessary that they should be dissolved in solvents or melted under heating so as to assume a liquid state. In dissolving the substances by the use of solvents, since no solvents have so far been discovered which have resistance to radioactive rays comparable with that offered by the substances, use of the solvents inevitably results in degradation of the resistance of the substances to radioactive rays. In converting the substances into a molten state under heating, it becomes necessary to incorporate in the lubrication system, a special device for heating. Because of these disadvantages, substances which are solid at room temperature are not feasible for use as working oil. Separately, working oils of petroleum origin (such as, for example, APL-710 produced by Shell Petroleum Co.) or phenyl silicone oils (such as, for example, F-4 produced by Shin-etsu Chemical), which are liquid at room temperature, have heretofore been utilized also as working oil for the aforementioned purpose.

However, the lubricants of petroleum origin mentioned above tend to decompose with simultaneous evolution of gas while in use. This phenomenon of gas evolution is quite troublesome in cases where the oil is used in a closed system especially in a high-speed propagating type or nuclear reactors in which an anti-shock and anti-vibration apparatus containing such an oil is provided on a pipe-line for melted sodium of the primary cooling system of the nuclear reactor.

Recently it was found that sodium in the pipe-line becomes to radioactive $^{24}Na$ by the irradiation of neutrons generated in the reactor, and the oill in the anti-earthquake apparatus is deteriorated by gamma ray from $^{24}Na$ to generate a large amount of a gas mainly composed of hydrogen. Although the deterioration of the oil, which changes the physical properties of the oil to the degree where the deteriorated oil can not exhibit the original performance of the initial oil is a large problem, the more important result is the afore-mentioned large volume of the gas generated from the deterioration, because the anti-earthquake apparatus containing such an oil is a closed vessel. Accordingly, the accumulated gas in the closed vessel of the anti-earthquake apparatus strongly hinders the performance of the apparatus. That is why the amount of the gas from the irradiated oil is widely tested in the selection of the oil to be used in such an anti-earthquake apparatus. This test is carried out by subjecting the candidate oil to the exposure of gamma ray from $^{60}Co$ in an atmospheric condition and also under highly reduced $5\times10^{-4}$ mmHg pressure at room temperature, the amount of exposure is $10^8$ R, $10^9$ R and $3\times10^9$R, in order of screening the candidate oils by a dose rate of $1.6\times10^6$R/hour (for the determination of the degree of deterioration of the oil) and $0.96\times10^6$R/hour for the determination of the amount of generated gas. The volume of the gas is calculated into more, then into the number of molecules of the generated gas. As is shown in Tables in the original specification, G value represents the number of molecules of the generated gas when the oil absorbed the radiation energy of 100 eV. In this case it is impossible to obtain the electron density of the oil, therefore, it is presumed that the electron density of the oil is nearly equal to that of water ($H_2O$). Accordingly, the energy absorbed by 1 g of the oil when it is subjected to the radiation of R roentgen is nearly $6.08\times10^{13}$ (unit being eV/R).

The G value is given by the following formula:

$$G=\frac{\text{Volume of gas generated from 1 gram of the oil (as Mole: } M)}{6.08\times10^{13}\times R}$$

$$=\frac{M\times6.02\times10^{23}\times100}{6.08\times10^{13}\times R}$$

In short, the G value is an index of the total volume (amount) of gas generated from a candidate oil during exposure to total radiation of R roentgen units. The larger the G value the less stable the candidate oil against radiation.

While the phenyl silicone oils tend to gel while serving as a working oil. Thus these oils also fail to serve as a satisfactory working oil resistant to radioactive rays.

Under the circumstances described above, there has been felt the strong necessity for developing an oil which has a high resistance to radioactive rays comparable with that of polyphenyl and its equivalents and which is liquid at room temperature.

SUMMARY OF THE INVENTION

It is, therefore, an object of the present invention to provide a novel radiation resistant oil which is liquid at room temperature, which has high resistance to radioactive rays, and which is suitable for use not only in lubricating parts but also in very important anti-earthquake apparatus provided in the secondary cooling system of high-speed propagating type of nuclear reactor. Other objects of the present invention will become apparent from the following description of the invention.

In view of the circumstances described above, the inventors pursued studies on numerous organic compounds in search for an oil which possesses properties desirable for use as the working oil. They have consequently found that a certain mixture of alpha-benzyl substitued methylnaphthalene isomers and beta-benzyl substituted methylnaphthalene isomers has a satisfactory resistance to radioactive rays and that it is liquid at normal room temperature. This invention has been accomplished on this knowledge.

This invention, therefore, is characterized by using alpha-benzyl substituted methylnaphthalene isomers and beta-benzyl-substituted methylnaphthalene isomers as the two main components.

Although L. A. Cort et al. disclose only one member of isomers of alpha-benzyl substituted methylnaphthalene, 1-benzyl-3-methylnaphthalene the isomer has, according to Cort et al. (J. Chem. Soc. 1964 (Aug.), 1844) a melting point of 58°-59° C. Their description could not suggest that the mixture of alpha-benzyl substituted methylnaphthalene isomers is liquid at a temperature around 0° C.

Also, M. C. Amaury discloses in his French Pat. No. 879,584, that simultaneously aralkyl and butyl-substituted naphthalene is usable as a lubricating oil, however, actually he discloses only two instances of benzyl- and butyl-substituted naphthalenes, and in his disclosure nothing is mentioned on the effect of position of benzyl group in naphthalene ring to the physical properties, especially the state of the products (liquid or solid at a temperature around 0° C.). Therefore, the large category of aralkyl- and alkyl-naphthalene of Amaury embraces the substance of the present invention, the characteristic properties of the substance of the present invention could not be derived from the basic idea of the disclosure of Amaury.

DETAILED DESCRIPTION OF THE INVENTION

Alpha-benzyl substituted methylnaphthalene isomers to be used as one of the main components in this invention is generally obtained by condensing beta-methylnaphthalene and benzyl chloride in the presence of a Friedel Crafts' catalyst such as aluminum chloride or a solid acid catalyst such as a silica-alumina or zeolite. The main product is a mixture of various isomers of mainly alpha-benzyl substituted methylnaphthalenes (positional isomers concerning methyl substituent), and has a boiling point in the range of from 360° to 380° C. Beta-benzyl substituted methylnaphthalene isomers to be used as the other of the main components is generally obtained as described above, however, using alpha-menthylnaphthalene as one of the reactant. The main product is a mixture of various isomers of mainly beta-benzyl substituted methylnaphthalenes (positional isomers concerning methyl substituent) and has nearly the same boiling range of the alpha-benzyl substituted methylnaphthalene isomers.

From the view point of the final products, a mixture of alpha- and beta-methylnaphthalenes may be used. As the catalyst to be used in producing benzylmethyl naphthalene as described above a solid acid catalyst such as silica-alumina is suitable by the reason that this catalyst is easily separated from the formed mixtures of benzyl-substituted methylnaphthalene isomers after the reaction. The ratio at which methylnaphthalene is used with respect to benzyl chloride in the production of benzyl-substituted methylnaphthalene is in the range of from 1 to 5 mol based on benzyl chloride. The reaction temperature is optimum in the range of from 90° C. to 110° C. The benzyl-substituted methylnaphthalene which is thus produced and which is used as the main component in the present invention has the following general properties:

| | |
|---|---|
| Specific gravity, $d_4^{15}$ | 1.070-1.080 |
| Viscosity (cst), at 100° F. | 35-13 |
| 200° F. | 4-3 |
| Flash point, °C. | 190 (minimum) |
| Pour point, °C. | 0 (maximum) |
| Refractive index, $n_D^{25}$ | 1.65-1.63 |
| Boiling point, °C. | 360-380 |

The formation of very small amount of di(benzyl)-substituted methylnaphthalene is observed in the above-mentioned reaction.

The mixture of alpha-benzyl substituted methylnaphthalene isomers and beta-benzyl substituted methylnaphthalene isomers, which is used as the main component in this invention does not suffer its resistance to radioactive rays to be degraded because of the presence of the di(benzyl)-substituted methylnaphthalene by-produced during its own production. Accordingly, there is no particular necessity for removing the by-produced and coexisting di(benzyl)-substituted methylnaphthalene from the product of the reaction between methyl naphthalene and benzyl chloride. This means that the products of said reaction may be used in its unaltered form, i.e., the form in which benzyl-substituted methylnaphthalene and di(benzyl)-substituted methylnaphthanlene are mixed, as a radiation resistant oil. In order to reduce the formation of di(benzyl)-substituted methylnaphthalene, it suffices for the purpose to increase the ratio of methylnaphthalene to benzyl chloride in the reaction of methylnaphthalene and benzyl chloride as much as possible within the afore-mentioned range.

As already described above and as will be demonstrated afterward by illustrative example, benzyl-substituted methylnaphthalene of the present invention possesses highly desirable resistance to radioactive rays and retains its liquid state at normal room temperatures, no matter whether it is used alone or in the presence a small amount of di(benzyl)-substituted methylnaphthalene. Thus, it is a highly usefull radiation resistant oil suitable as a lubricant for atomic power facilities. Besides, the mixture of alpha-benzyl substituted methylnaphthalene isomers and beta-benzyl substituted methylnaphthalene isomers or alpha-benzyl substituted methylnaphthalene isomers themselves is capable of advantageously dissolving the afore-mentioned substances such as polyphenyl ether which are solid at normal room temperature and yet possess high resistance to radioactive rays. It can, therefore, be mixed with such a substance and used as a radiation resistant oil.

This invention, accordingly, is believed to contribute greatly to the nuclear power industry, technically and economically.

The present invention will be described more specifically with reference to preferred embodiments, which are to be interpreted as illustrative and not in a limiting sense.

EXAMPLE 1

Two hundred and eightyfour grams (2 moles) of a mixture of alpha-methylnaphthalene and beta-methylnaphthalene with a weight ratio of alpha to beta of 40:60 were mixed with 10 g of a silica-alumina catalyst and heated to a temperature of 100° C. and, while under agitation, 126.5 g (1 mol) of benzyl chloride was introduced dropwise therein to permit a reaction to ensue. After the completion of this reaction, hydrogen chloride which remained dissolved in the reaction product was neutralized and the product was washed with water and distilled. Consequently, there were obtained 185 g (about 0.8 mol) of a mixture of alpha-benzyl substituted methylnaphthalene isomers and beta-benzyl substituted methylnaphthalene isomers with the weight ratio of alpha to beta of 75:25 and about 0.1 mole of di(benzyl)-substituted methylnaphthalene.

Subsequently, the above-mentioned product was irradiated in a test indicated in Table 1.

In the test, effects of varying irradiation conditions upon properties of the product were determined. The results obtained are shown in Table 1. It is clear from Table 1 that the product mainly consisting of a mixture of alpha-benzyl substituted methylnaphthalene isomers and beta-benzyl substituted methylnaphthalene isomers with a weight ratio of 75:25 and containing a small amount of di(benzyl)-substituted methylnaphthalene (this may be a mixture of isomers) does not show any appreciable change in its properties due to varying irradiation conditions, indicating that it offers high resistance to radioactive rays.

When the above-mentioned product was irradiated with gamma rays from cobalt 60 as the source of the gamma rays, the G value of the generated gas was 0.012 after the dose of $10^8$ R and 0.034 after the dose of $10^9$ R respectively. This indicates that the products mainly consisting of alpha-benzyl substituted methylnaphthalene isomers and of beta-benzyl substituted methylnaphthalene at a weight ratio of 75:25 and containing a small amount of di(benzyl)-substituted methylnaphthalene is excellent also in terms of G value of generated gas from the product.

TABLE 1

| Atmosphere | Dosage (Roentgen) | Specific gravity ($d_4^{15}$) | Viscosity(cst) 100° F. | Viscosity(cst) 210° F. | Flash point (°C.) | Pour point (°C.) |
|---|---|---|---|---|---|---|
| — | 0* | 1.077* | 17.79* | 3.39* | 196* | −15* |
| Vac. | $10^8$ | 1.073 | 17.8 | 2.93 | 198 | −15 |
| Vac. | $10^9$ | 1.071 | 20.3 | 3.40 | 190 | −17.5 |
| Vac. | $3 \times 10^9$ | 1.078 | 27.7 | 3.65 | 166 | −20 |
| Air | $10^8$ | 1.077 | 19.9 | 3.11 | 190 | −15 |
| Air | $10^9$ | 1.074 | 19.9 | 3.08 | 200 | −20 |
| Air | $3 \times 10^9$ | 1.078 | 24.7 | 3.39 | 198 | −22.5 |

Note:
*before irradiation.

EXAMPLE 2

The same amount of the same mixture of alpha-methylnaphthalene and beta-methylnaphthalene as in Example 1 was mixed with 10 g of ferric chloride as a Friedel-Crafts' catalyst and heated to a temperature of 100° C. and, while under agitaion, 126.5 g (1 mol) of benzyl chloride was introduced dropwise therein to permit a reaction to ensue. After completion of this reaction, hydrogen chloride which remained dissolved in the reaction product was neutralized and said reaction product was washed with water and distilled. Consequently, there were obtained 185 g (about 0.8 mole) of a mixture of alpha-benzyl substituted methylnaphthalene isomers and beta-benzyl substituted methylnaphthalene isomers with a weight ratio of 80:20 of alpha-to beta-isomers and a small amount (about 0.1 mole) of di(benzyl)-substituted methylnaphthalene. After cooling the product to −5° C. and then removing the separated crystalline substance mainly consisting of beta-benzyl substituted methylnaphthalene isomers, a mixture of alpha-benzyl substituted methylnaphthalene isomers and beta-benzyl substituted methylnaphthalene isomers of a ratio of alpha to beta of 50:50 was obtained as an oil which does not solidify at about 0° C. not separate any more amount of the crystalline substance.

Subsequently, the 50:50 mixture above-mentioned was irradiated, to a total dose of $10^8$ R., with gamma rays from cobalt 60 as the source of the gamma rays, to determine the properties of the compound for possible change due to the irradiation. The results are shown in Table 2 below. For the purpose of comparison, the same test was performed on a lubricant of the petroleum origin (APL-710 produced by Shell Petroleum Co.) and phenyl silicone oil produced by Shin-etsu Chemical) which are generally used as lubricants for atomic power facilities, with the properties of the oils examined for change due to the irradiation.

The results are also shown in Table 2.

It is clear from Table 2 that the mixture of alpha-benzyl substituted methylnaphthalene isomers and beta-benzyl substituted methylnaphthalene isomers of a weight ratio of alpha to beta of 50:50 far excells the other lubricants in terms of resistance to radioactive rays.

TABLE 2

| | The 50:50 mixture* | | Lubricant of petroleum origin | | Phenyl silicone oil | |
|---|---|---|---|---|---|---|
| | Before irradiation | After $10^8$ R irradiation | Before irradiation | After $10^8$ R irradiation | Before irradiation | After $10^8$ R irradiation |
| Specific gravity, $d_4^{15}$ | 1.077 | 1.073 | 0.877 | 0.883 | 1.070 | 1.079 |
| Viscosity (cst), 100° F. | 17.8 | 17.8 | 33.3 | 41.7 | 180 | 210 |
| Flash point, °C. | 196 | 198 | 165 | 165 | 210 | 210 |
| Pour point, °C. | −15 | −15 | −25 | −25 | −35 | −35 |
| G value of generated gas | — | 0.012 | — | 2.05 | — | 0.02 |

Note:
*of alpha-benzyl methylnaphthalene and beta-benzyl methylnaphthalene

EXAMPLE 3

Mixtures consisting of a mixture of alpha-benzyl substituted methylnaphthalene isomers and beta-benzyl substituted methylnaphthalene isomers and di(benzyl)-substituted methylnaphthalene at weight ratios of 90:10 and 70:30 respectively were prepared. The mixtures were irradiated to a dosage of $10^8$ R. by the gamma rays from cobalt 60 as the radioactive ray source, with the properties of the mixtures determined before and after said irradiation. The results are shown in Table 3 below.

It is seen from Table 3 that the mixtures of a mixture of alpha-benzyl substituted methylnaphthalene isomers and beta-benzyl substituted methylnaphthalene isomers (A) and di(benzyl)-substituted methylnaphthalene (B) also exhibit outstanding resistance to radioactive rays.

TABLE 3

| | Mixture, 90:10, of A and B | | Mixture, 70:30, of A and B | |
|---|---|---|---|---|
| | Before irradiation | After irradiation | Before irradiation | After irradiation |
| Specific gravity, $d_4^{15}$ | 1.077 | 1.076 | 1.078 | 1.078 |
| Viscosity (cst), 100° F. | 40 | 41 | 57 | 59 |
| Flash point, °C. | 200 | 200 | 211 | 211 |
| Pour point, °C. | −15 | −15 | −12.5 | −12.5 |
| G value of generated gas | — | 0.012 | — | 0.012 |

We claim:

1. A radiation resistant working oil suitable for use as a lubricant or medium for parts of atomic power facilities and nuclear reactors which are exposed to strong radiation, consisting essentially of a mixture of alpha-benzyl substituted methylnaphthalene isomers and beta-benzyl substituted methylnaphthalene isomers at a weight ratio of said alpha-benzyl methylnaphthalene isomers to said beta-benzyl methylnaphthalene isomers of from 50:50 to 95:5, said mixture being prepared by condensing alpha- and beta-methylnaphthalenes with benzyl chloride in the presence of Friedel Crafts' catalyst.

2. A method of lubricating parts of atomic power facilities and nuclear reactors which are exposed to strong radiation comprising applying to said parts a substance consisting essentially of a mixture of alpha-benzyl substituted methylnaphthalene isomers and beta-benzyl substituted methylnaphthalene isomers at a weight ratio of said alpha-benzyl substituted methylnaphthalene isomers to beta-benzyl substituted methylnaphthalene isomers of from 50:50 to 95:5, said mixture being prepared by condensing alpha- and beta-methylnaphthalenes with benzyl chloride in the presence of Friedel Crafts' catalyst.

3. The method of claim 2 wherein said parts of atomic power facilities and nuclear reactors are hydraulic actuators, hydraulic shock absorbers or anti-earthquake vibration insulators.

* * * * *